US010008070B2

(12) United States Patent
Nordahl et al.

(10) Patent No.: US 10,008,070 B2
(45) Date of Patent: Jun. 26, 2018

(54) ELECTRONIC GAMING TABLE

(75) Inventors: Mats Nordahl, Göteborg (SE); Jonas Skoog, Billdal (SE); Wiktor Skoog, legal representative, Göteborg (SE)

(73) Assignee: Tangiamo AB, Göteborg (SE)

( * ) Notice: Subject to any disclaimer, the term of this patent is extended or adjusted under 35 U.S.C. 154(b) by 0 days. days.

(21) Appl. No.: 11/307,123

(22) Filed: Jan. 24, 2006

(65) Prior Publication Data

US 2011/0065513 A1 Mar. 17, 2011

Related U.S. Application Data

(60) Provisional application No. 60/593,547, filed on Jan. 24, 2005.

(51) Int. Cl.
*G07F 17/32* (2006.01)

(52) U.S. Cl.
CPC ..... *G07F 17/32* (2013.01); *G07F 17/322* (2013.01)

(58) Field of Classification Search
CPC ..... G07F 17/322; G07F 17/3216
USPC ..... 273/292, 309; 463/11, 12, 46
See application file for complete search history.

(56) References Cited

U.S. PATENT DOCUMENTS

| | | | | |
|---|---|---|---|---|
| 5,586,936 | A * | 12/1996 | Bennett et al. | 463/25 |
| 5,713,573 | A * | 2/1998 | Nazaryan | 273/292 |
| 5,986,224 | A * | 11/1999 | Kent | 178/18.04 |
| 6,007,427 | A * | 12/1999 | Wiener et al. | 463/17 |
| 6,607,443 | B1 * | 8/2003 | Miyamoto et al. | 463/40 |
| 6,722,974 | B2 * | 4/2004 | Sines et al. | 463/12 |
| 7,553,236 | B2 * | 6/2009 | Parra et al. | 463/46 |
| 2002/0077170 | A1 * | 6/2002 | Johnson et al. | 463/16 |
| 2005/0049049 | A1 * | 3/2005 | Griswold et al. | 463/46 |
| 2005/0164759 | A1 * | 7/2005 | Smith et al. | 463/11 |
| 2006/0058086 | A1 * | 3/2006 | White et al. | 463/11 |
| 2006/0058088 | A1 * | 3/2006 | Crawford, III | G07F 17/3227 463/13 |
| 2007/0296151 | A1 * | 12/2007 | Kyrychenko | 273/309 |

* cited by examiner

*Primary Examiner* — Jay Liddle
(74) *Attorney, Agent, or Firm* — RMCK Law Group PLC

(57) ABSTRACT

Method and arrangement for providing an electronic gaming table (10) that is adapted for playing a table game, which electronic gambling table (10). The table (10) includes a table top (20) provided with at least one substantially continuous playing surface (100) arranged for dynamically and substantially simultaneously displaying the current game status for at least two players participating in the game currently played on the electronic gaming table (10). The playing surface (100) is implemented by means of at least one touch screen (110) that is arranged to receive and detect touches from said plurality of players.

10 Claims, 7 Drawing Sheets

ELECTRONIC GAMING TABLE

FIELD OF THE INVENTION

The present invention relates to an electronic gaming machine. More particularly, the invention relates to an electronic gaming table for playing table games that are traditionally played in casinos.

BACKGROUND OF THE INVENTION

Electronic gaming machines have been created to simulate a number of different casino games, including blackjack, twenty-one, craps, slot machines etc. However, many electronic gaming machines are restricted to a single player or restricted to gaming tables around which several players will sit and operate their own separate electronic player terminal.

At the same time it should be recognized that advantages have been achieved by electronic gaming machines, e.g. regarding computerize betting, which reduces the risk of post betting, moved or hided bets etc. Electronic gaming machines may also avoid the risk of manipulation of the roulette wheel in the case of a roulette game. The risk of miscalculation of the winning combination and the winning amounts may also be reduced by electronic gaming machines.

However, it has been found to be important that electronic gaming machines for playing table games can simulate a live action game as closely as possible so that players and others can enjoy the shared spontaneity and excitement that comes with watching and participating in a traditional table game setting in a live casino.

Consequently, there is a need for an improved electronic gaming table that increases the feeling of shared spontaneity and excitement that comes with watching and participating in a traditional table-game setting, and which at the same time maintains as many as possible of the advantages achieved by known electronic gaming machines.

SUMMARY OF THE INVENTION

The invention provides for a electronic gaming table with improved simulation of a live table game.

This is accomplished by an electronic gaming table that is adapted for playing a table game, which electronic gambling table comprises a table top provided with at least one substantially continuous playing surface arranged for dynamically and substantially simultaneously displaying the current game status for at least two players participating in the game currently played on the electronic gaming table, wherein the playing surface is implemented by means of at least one touch screen that is arranged to receive and detect touches from said plurality of players.

It is preferred that a separate area is provided on the touch screen for each player in said plurality of players, which area is arranged to receive and detect touches from said player.

It is also preferred that said separate area at least displays a betting area or a card hand that is associated with said player.

Additionally it is preferred that said touch screen is arranged to detect and distinguish between touches made substantially simultaneously on different areas of the touch screen.

The invention also comprises a method for using the electronic gambling table.

Further advantages of the present invention and embodiments thereof will appear from the following detailed description of the invention.

DETAILED DESCRIPTION OF PREFERRED EMBODIMENTS OF THE INVENTION

The invention will be described in more detail below with reference to an exemplifying shared electronic gaming table represented by a shared electronic roulette table. Other embodiments of the invention are clearly conceivable and the invention is by no means limited to the exemplifying shared electronic roulette table as described below.

The Gaming Table

Figure 1A:
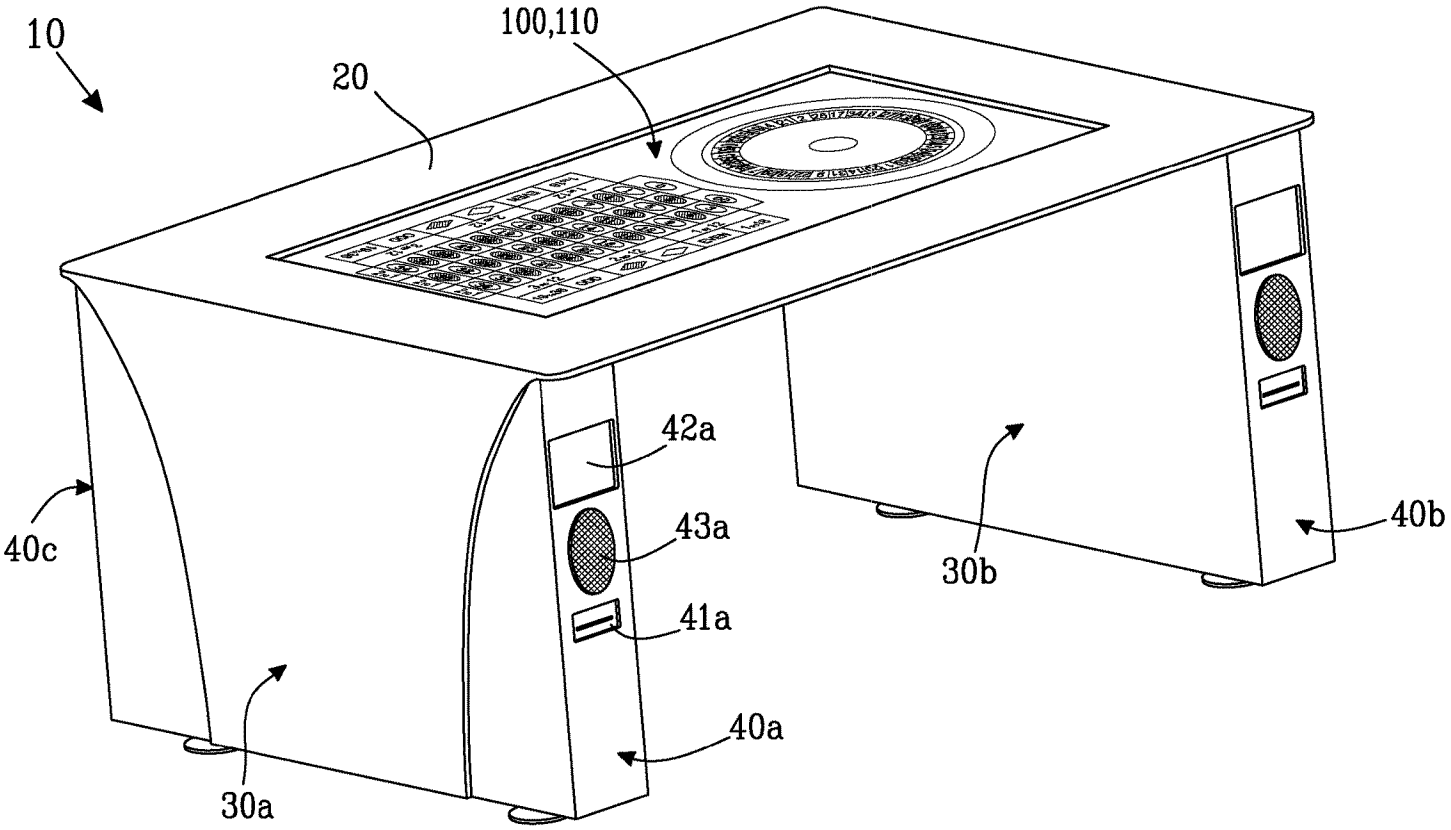
FIG. 1*a* shows a perspective illustration of a shared electronic gambling table according to an exemplifying embodiment of the present invention.

FIG. 1*a* shows a perspective view of a shared electronic gaming table 10 according to a preferred embodiment of the present invention. The shared electronic gaming table 10 comprises a substantially rectangular and horizontally arranged table top 20. The table top 20 is supported by two vertical sides 30*a*, 30*b*, each arranged at one of the short sides of the horizontal table top 20. However, the invention is not limited to the substantially rectangular table top 20 shown in FIG. 1*a*. On the contrary, several other shapes are clearly conceivable, e.g. an oval shape, a triangular shape or some other polygonal shape, or shapes with chamfered corners, with indentations or grooves etc. In addition, the table top 20 is not limited to a particular size. On the contrary, a table top 20 may be of a size that allows two players, three players, four players, five players, six players or more comfortably standing or sitting around the gaming table 10. Moreover, the invention is not limited to the floor supports 30*a*, 30*b* shown in FIG. 1*a*. On the contrary, several other support arrangements are conceivable, e.g. different types and configurations of pillars, columns, posts or similar.

Figure 1B:
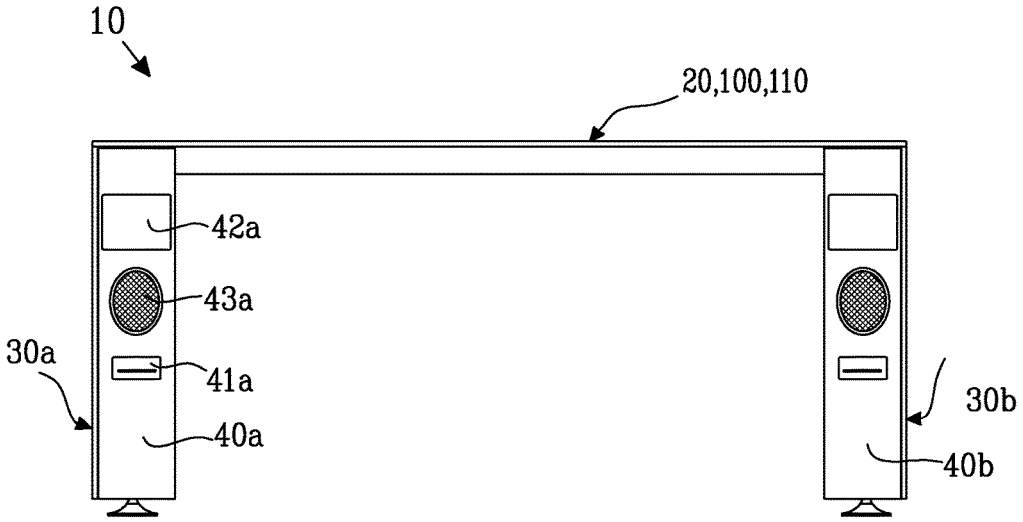
FIG. 1*b* shows a side view of the shared electronic gambling table in FIG. 1*a*.

FIG. 1*b* shows a first short side 31*a*, 31*b* of the two vertical supporting sides 30*a*, 30*b*. The second short side of the supporting sides 30*a*, 30*b* is not shown in FIG. 1*b*. The first short sides 31*a*, 31*b* are each provided with a player console 40*a*, 40*b*. The second short sides that are hidden in FIG. 1*b* are similarly provided with a player console 40*c*, 40*d*. It is preferred that the player consoles 40*a*-40*d* of the shared electronic gaming table 10 are substantially identical. The arrangements that are preferably comprised by an exemplifying player console 40*a*-40*d* will now be described with reference to the player console 40*a*. The arrangements are denoted 41*a*, 42*a* and 43*a*. Substantially identical arrangements are comprised by the player consoles 40*b*-40*d* of the shared electronic gaming table 10, however denoted 41*b*, 42*b*, 43*b*; 41*c*, 42*c*, 43*c* and 41*d*, 42*d*, 43*d*.

The player console 40*a* is preferably provided with a payment arrangement 41*a*. The payment arrangement 41*a* may e.g. be a bill insert for inserting bills; a card reader for reading credit cards or special casino cards or special hotel cards (e.g. the key card to a hotel room etc) or similar; or an input for coins, chips, markers or tokens or similar. It is also preferred that the player console 40*a* is provided with a payout arrangement 42*a*. The payout arrangement 42*a* may e.g. be a coin return hopper for coins, chips, markers, tokens or similar; or a printer output for a printed ticket, coupon, voucher or similar. Finally it is preferred that the player console 40*a* is provided with a loudspeaker 43*a* or similar through which a player sitting or standing near the player console 40*a* can be informed about the progress of the game, e.g. when to place bets, when to stop placing bets, the winning number etc. It is preferred that the information is provided by a croupier or similar. It should be emphasized that the croupier function may be performed by a sole human croupier, by a human croupier supported by a computer or similar, or solely by a computer or similar.

The player console 40*a* is not limited to comprise a payment arrangement 41*a*, a payout arrangement 42*a* and a loudspeaker 43*a* as indicated above. On the contrary, a player console 40*a* may comprise other arrangements as well as fewer or additional arrangements. For example, it is preferred that the player console 40*a* is provided with a control unit (not shown) with the suitable software and hardware for controlling and communicating with the payment arrangement 41*a*, the payout arrangement 42*a* and the loudspeaker 43*a*. It is also preferred that the control unit in the player console 40*a* is provided with the suitable software and hardware for communicating with the table control unit 50 as described next.

Figure 1C:
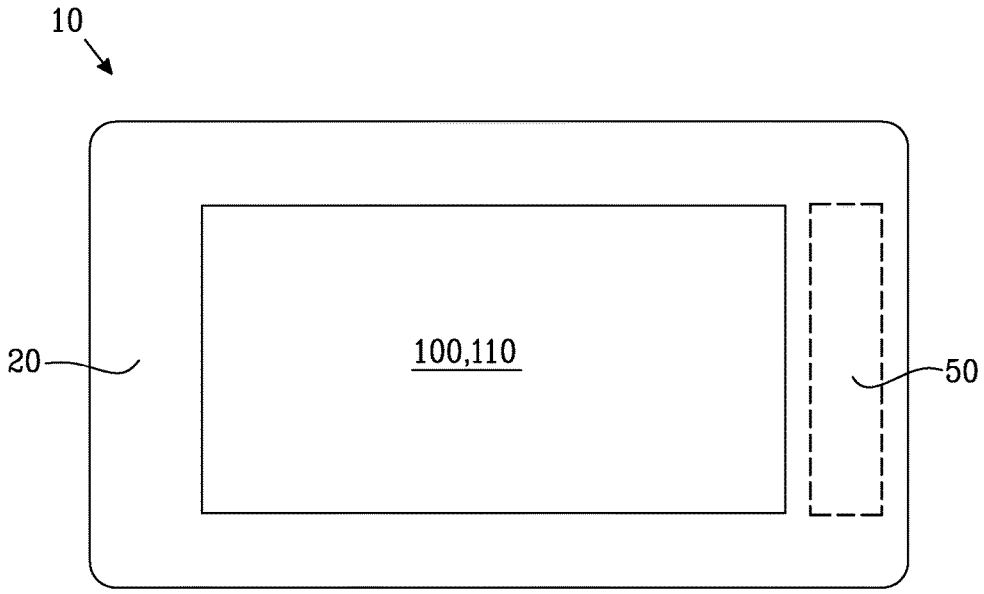
FIG. 1*c* shows a top view of the shared electronic gambling table in FIGS. 1*a* and 1*b*.

FIG. 1*c* shows a top view of the shared electronic gaming table 10. The shared electronic gaming table 10 is provided with a playing surface 100 implemented by means of a touch screen 110 that is arranged at the top surface of the shared electronic gaming table 10. The shared electronic gaming table 10 is also provided with a table control unit 50 that is arranged at a suitable position within the table 10.

The table control unit 50 is preferably provided with the suitable software and hardware for operating the shared electronic gaming table 10 and the specific game that is currently played on the table 10. It is particularly preferred that the control unit 50 is provided with the suitable interface hardware and software for operating the touch screen 110 and the player consoles 40*a*-40*d* as described above. The table control unit 50 can be an ordinary PC or similar that is provided with the suitable software and hardware. However, the table control unit 50 may be wholly or partly distributed to the control units that may be arranged in the player consoles 40*a*-40*d*. The table control unit 50 may also be at least partly arranged in an external control unit that is arranged outside the shared electronic gaming table 10.

The touch screen 110 is arranged to dynamically display the layout of the playing surface 100, e.g. to dynamically display the current status of a betting area or similar that is associated with the specific table game that is played at the shared electronic gaming table 10, or to display the current status of the cards or similar that is currently played in the specific card game or similar that is played at said electronic gaming table 10. The displayed betting area may e.g. be various betting areas that are associated with the game of roulette, craps, or similar. The displayed cards may e.g. be the cards of a blackjack game, a twenty-one game, a red dog game, a baccarat game or similar. The touch screen 110 is moreover adapted to display other features that are required for the particular game, e.g. to display the roulette wheel in a roulette game or the dices in a craps game or similar. The touch screen 110 can also be adapted to display and point out the winner (e.g. the winning number, the winning card or card hand etc) and to display other events that occur during the game. It is moreover preferred that the touch screen 110 displays the chips that are available for betting and the touch buttons that are required for controlling the game and similar features that may not be directly related to the layout of a betting area in games like roulette or related to the cards in a card game like blackjack or similar. In fact, substantially the whole surface of the touch screen 110 can be arrange to dynamically display different images and features that are related to the game and also arranged to receive and detect touches from the players that corresponds to and results in various requested functions. It should be emphasized that the single playing surface 100 implemented by the touch screen 110 is arranged to display the current game status for all players that are participating in the game played on the shared electronic gaming table 10. The single playing surface 100 implemented by the touch screen 110 is similarly arranged to receive and detect touches from all players that are participating in the game played on the shared electronic gaming table 10.

The Playing Surface

Figure 2A:
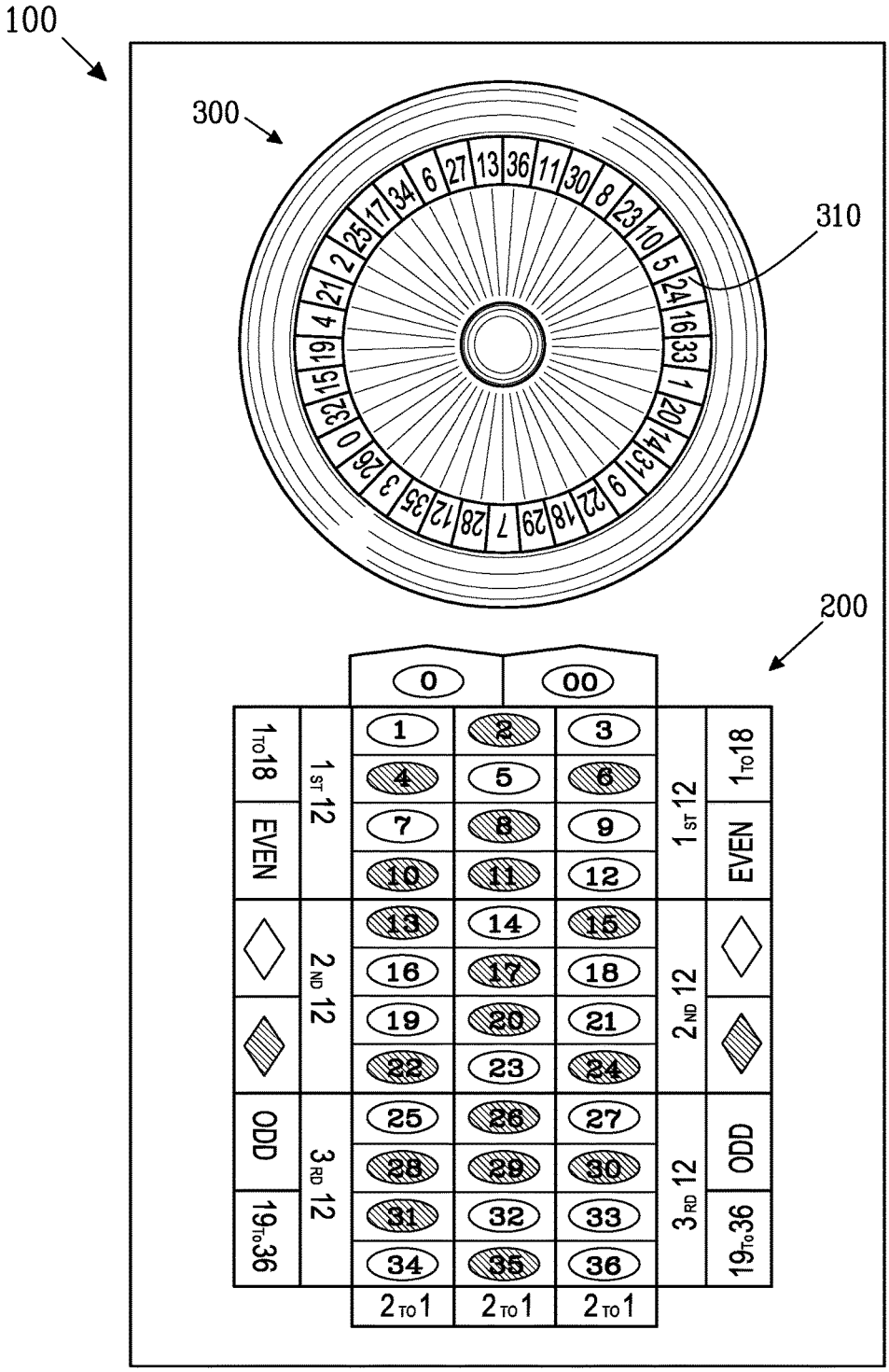
FIG. 2*a* shows a playing surface with a shared betting area according to an exemplifying embodiment of the present invention.

FIG. 2*a* shows an exemplifying embodiment of the playing surface 100. The playing surface 100 in FIG. 2*a* displays a combination of an exemplifying betting area 200 and an exemplifying roulette wheel 300 that are traditionally used in the game of roulette. However, the invention is not limited to the game of roulette.

A Roulette Wheel

As shown in FIG. 2*a*, the periphery 310 of the exemplifying roulette wheel 300 is divided into thirty-seven equal segments numbered from zero through thirty-six in random order. Each numbered segment is provided with a red or black area (alternately shaded in FIG. 2*a* to illustrate red or black respectively) that identifies the associated number as one of the red or black classifications of numbers.

A Shared Betting Area

The layout of the exemplifying betting area 200 in FIG. 2*a* illustrates that the same numbers are assigned to thirty-seven areas arranged in rows and columns. The thirty-six areas numbered "1-36" are arranged in three columns and twelve rows numbered in sequence beginning at the top of the left hand column with the number "1" and moving from left to right in each row and progressing downward from the top row to the bottom row so that the last area at the bottom of the third column is assigned the number "36". The numbered areas of the betting area 200 in FIG. 2*a* are alternately shaded to illustrate red or black in correspondence with the red and black identification of each number as established on the wheel 300. Thus, for example, the number 34 which is a red segment on the wheel 300 has a red background on the layout of the betting area 200, whereas the number 35 which is a black segment on the wheel 300 has a black background on the layout of the betting area 200.

In addition, an area marked "0" is located substantially above the area marked "1" and an area marked "00" is located substantially above the area marked "3", whereas an area marked "2TO1" is located below each of the areas marked "34", "35" and "36".

Moreover, an area marked "1ST 12" is arranged to the left of the areas marked "1", "4", "7" and "10". An area marked "2ND 12" is similarly arranged to the left of the areas marked "13", "16", "19" and "22", whereas an area marked "3RD 12" is arranged to the left of the areas marked "25", "28", "31" and "34". Additionally, an area marked "1TO18" is arranged to the left and at the upper half of the area denoted "1ST 12", whereas an area marked "EVEN" is arranged to the left and at the lower half of the area denoted "1ST 12". An area marked with a red symbol in the form of a polygon is arranged to the left and at the upper half of the area denoted "2ND 12", whereas an area marked with a black symbol in the form of a similar polygon is arranged to the left and at the lower half of the area denoted "2ND 12". Finally, on the left side of the exemplifying betting area 200 in FIG. 2, an area marked "ODD" is arranged to the left and at the upper half of the area denoted "3RD 12", whereas an area marked "19TO36" is arranged to the left and at the lower half of the area denoted "3RD 12".

The right side of the exemplifying betting area 200 in FIG. 2*a* is provided with areas corresponding to the above mentioned left side areas marked "1ST 12", "2ND 12", "3RD 12", "1TO18", "EVEN", the areas comprising a red and a black symbol in the form of two similar polygons and the areas marked "ODD" and "19TO36".

Separate Betting Areas

Figure 2B:
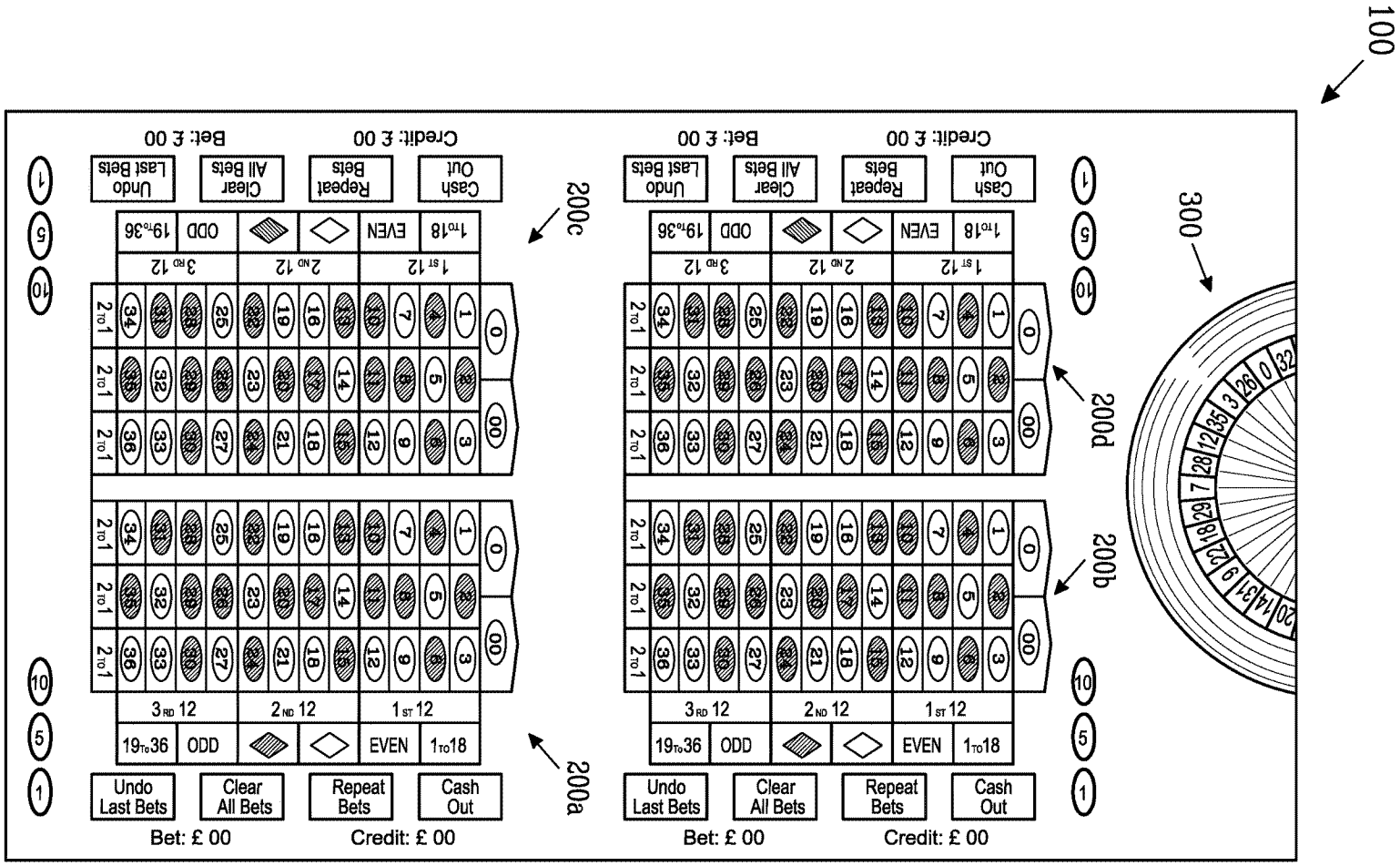
FIG. 2*b* shows a playing surface with four separate betting areas according to an exemplifying embodiment of the present invention.

The appearance of the exemplifying playing surface 100 shown in FIG. 2*a*, comprising the shared betting area 200 and the roulette wheel 300, is preferably changed when the game begins or at least when the betting begins. As shown in FIG. 2*b* the shared betting area 200 in FIG. 2*a* is reproduced into four (4) separate and substantially identical betting areas 200*a*-200*d* displayed on the playing surface 100. The betting areas 200*a*-200*d* are associated with the player consoles 40*a*-40*d* as follows: player console 40*a* is associated with betting area 200*a*, player console 40*b* is associated with betting area 200*b*, player console 40*c* is associated with betting area 200*c* and player console 40*d* is associated with betting area 200*d*. Hence, a player is supposed to use a combination of a specific betting area 200*a*-200*d* and the player console 40*a*-40*d* associated with that specific betting area 200*a*-200*d*.

Hence, the amount following the text "Credit:" below the betting area 200*a* will increase when a player inserts an amount of money or similar in the payment arrangement 41*a* arranged in the player console 40*a*. The payout arrangement 42*a* of the player console 40*a* will similarly payout the accumulated winnings when a player touches the touch button denoted "Cash Out" implemented by the touch screen 110 below the betting area 200*a*. The other touch buttons implemented by the touch screen 110 below the betting area 200*a*—i.e. "Undo Last Bet", "Clear All Bets" and "Repeat Bets"—are also associated with the betting area 200*a*. The function of these buttons follows from the self explanatory text. Moreover, there are three circular chip symbols denoted "1", "5" and "10" arranged as touch buttons implemented by the touch screen 110 to the left of the betting area 200*a*. A bet can e.g. be placed by simply touching one of the chip symbols and drag the symbol to the desired position on the betting area 200*a*. However, it is preferred that a bet is placed by touching one of the chip symbols followed by one or several touches of the desired position or positions in the betting area 200*a*. Another chip value can be chose by touching another chip symbol followed by one or several touches of the desired position or positions in the betting area 200*a*. The amount following the text "Bet:" below the betting area 200*a* will increase by the amount of the chosen chip multiplied by the number of bets that are made with that chip. The amount following the text "Credit:" will correspondingly decrease with the same amount.

What has been said above about the betting area 200*a*, the touch buttons associated with the betting area 200*a* and the player console 40*a* is also applicable mutatis mutandis to the other betting areas 200*b*-200*d* and the other player consoles 40*b*-40*d*.

The betting areas 200*a*-200*d* and their associated touch buttons as exemplified above are preferably separated from each other and from other parts of touch screen 110 by a partitioning of the touch screen 110. A partitioning can e.g. be accomplished by dividing the touch screen 110 into a number of small touch screens—e.g. one touch screen for each betting area—arranged adjacent to each other substantially without any barriers or spaces in between. A touch on one small touch screen can then easily be distinguished from a simultaneous touch on another small touch screen. A partitioning of the touch screen 110 may also be accomplished by utilizing surface wave technology or similar, which makes it possible to analyze the touch screen 110 so as to detect and distinguish between touches made substantially simultaneously on different areas of the touch screen 110. The surface wave technology is e.g. commercially available in the "iTouch" touch monitors from ELo TouchSystems, Inc. 301 Constitution Drive, Menlo Park, Calif. 94025-1110 USA. The ability of the touch screen 110 to detect and distinguish between touches made substantially simultaneously on different areas of the screen 110 makes it possible to detect and distinguish a touch made on one betting area 200*a*-200*d* and its associated touch buttons from a touch made simultaneously on other betting areas 200*a*-200*d* and their associated touch buttons. This is highly preferred for the exemplifying playing surface 100 which emulates the game setting of a traditional a table game and which surface 100 consequently is used simultaneously by a plurality of players. Without the detecting and distinguishing property of the touch screen 110 the bets and commands etc requested by different touches on the screen 110 will be confused and neariy impossible to separate.

It should be added that at least a part of the roulette wheel 300 is preferably displayed on the playing surface 100 together with the four betting areas 200*a*-200*d* in FIG. 2*b*. The roulette wheel 300 is preferably spinning. It should also be added that the invention is not limited to four separate betting areas. On the contrary, the numbers of betting areas that can be displayed the playing surface 100 are mainly limited by the area available on the touch screen 110 and of course by such practical considerations as usability (e.g. the betting areas must not be too small). Hence, the numbers of betting areas may be 2, 3, 4, 5, 6, 7, 8 or more depending on the area available on the touch screen 110 and depending on the usability.

The appearance of the playing surface 100 shown in FIG. 2*b* is preferably changed back to assume the appearance of the shared betting area 200 shown in FIG. 2*a* when the time defined for bet allocations has expired.

A Shared Electronic Gaming System

Figure 3:
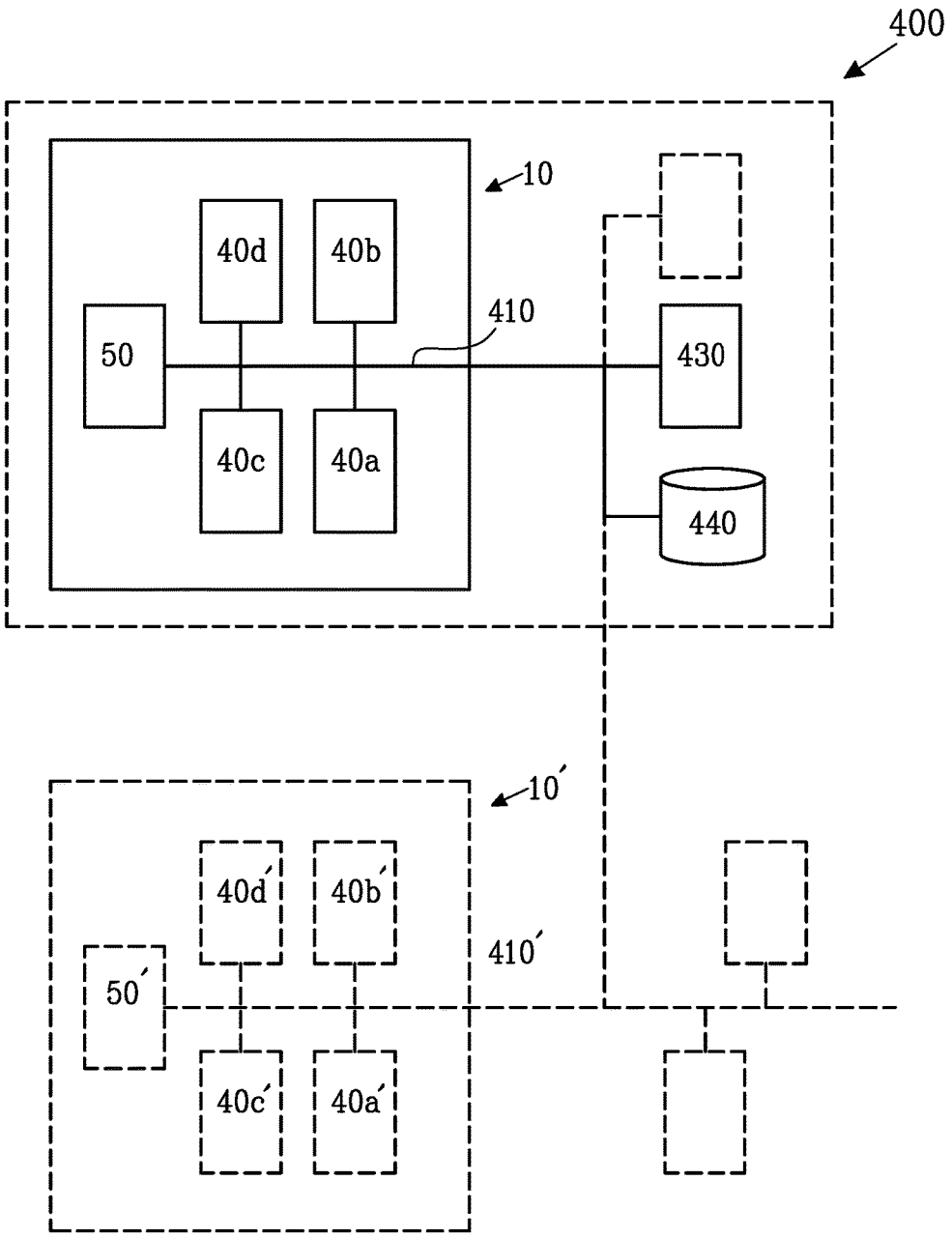
FIG. 3 shows a shared electronic gaming system according to an exemplifying embodiment of the present invention.

FIG. 3 shows an exemplifying shared electronic gaming system 400 according to a preferred embodiment of the present invention. The gaming system 400 comprises a shared electronic gaming table 10 with four player consoles 40*a*-40*d* and a table control unit 50 as describe above. It is moreover preferred that the gaming system 400 comprises a croupier console 430 and a roulette wheel unit 440. The player consoles 40*a*-40*d*, the table control unit 50, the croupier console 430 and the roulette wheel unit 440 are connected to each other for exchanging information by means of a transmission network 410. The transmission network 410 may be a data network, e.g. an Ethernet network or some other suitable data network that is commonly used in connection with an ordinary PC.

The croupier console 430 in FIG. 3 is preferably implemented by means of an ordinary PC (not shown) or similar that is provided with a touch screen (not shown) or similar.

However, the croupier console 430 may alternatively be an integrated part of the table control unit 50 arranged within the shared electronic gaming table 10, in which case an area of the touch screen 110 may be allocated as a touch screen for the croupier console 430.

Figure 4:
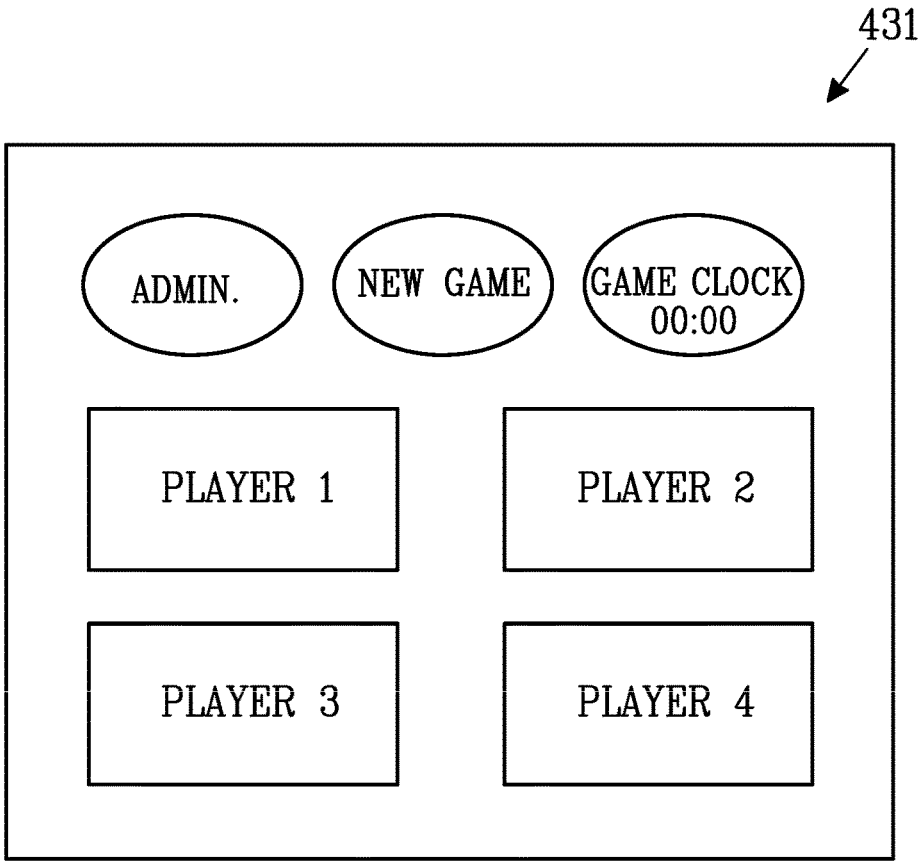
FIG. 4 shows a control image according to an exemplifying embodiment of the present invention.

FIG. 4 shows a preferred main control image 431 that can be viewed by the croupier running the game. The main control image 431 is displayed by the touch screen or similar that is associated with the croupier console 430 and it represents various options available. The area denoted "ADMIN" allows the croupier to control a number of specific functions, such as pausing a current game, configuring max/min bets and opening and closing the croupier console 430 etc. The areas denote "PLAYER 1" to "PLAYER 4" allows the croupier to view the status of each player console 40*a*-40*d*, e.g. the amount of betting money left in a certain player console 40*a*-40*d*, the various bets that have been placed in connection with a certain player console 40*a*-40*d* etc. The area denoted "GAME CLOCK" allows the croupier to see the current amount of time remaining for bet allocation. This may also be displayed on the playing surface 100, e.g. in connection with each separate betting area 200*a*-200*d* or at a visible central position on the playing surface 100.

The roulette wheel unit 440 in FIG. 3 is preferably implemented by means of a traditional manually operated roulette wheel (not shown) that is reproduced (filmed) by a common high quality electronic camera (not shown) or any other suitable electronic reproducing device. The electronic camera signals comprising the reproduced roulette wheel is preferably transmitted to the shared electronic gaming table 10 via the transmission network 410. Some embodiments of the invention may require a dedicated coaxial cable or similar for a transmission of the camera signals. The electronic camera signals is received and processed by the table control unit 50 or similar and then provided to the touch screen 110 so that a roulette wheel 300 can display on the playing surface 100, e.g. as previously described in connection with FIGS. 2*a* and 2*b*. However, the roulette wheel unit 440 may alternatively be an integrated part of the table control unit 50 that is arranged within the shared electronic gaming table 10. The roulette wheel and the ball that is traditionally dropped by a croupier into the roulette wheel are then preferably simulated by the croupier control unit 430 or the table control unit 50 or similar.

FIG. 3 is also showing that that one or several additional shared electronic gaming tables 10' can be connected to the shared electronic gaming system 400. The items denoted 40*a*'-40*d*', 50' and 410' correspond mutatis mutandis to the previously discussed items denoted 40*a*-40*d*, 50 and 410. It is then preferred that the electronic gaming system 400 operates as a master, which i.a. implies that a gaming system only needs one croupier control unit 430 and one roulette wheel unit 440 even if the system is extended by one or several additional shared electronic gaming tables. However, it should be emphasized that some gaming systems may have several croupier control units 430, each provided with a roulette wheel unit 440. An electronic gaming table 10, 10' in such gaming systems can be supplied from any of the croupier control units 430 and the roulette wheel unit 440 associated with that croupier control unit 430. The particular croupier control unit 430 and the roulette wheel unit 440 associated therewith is preferably selected from the electronic gaming table 10, 10', e.g. selected by the players at the gaming table.

The Function of the Exemplifying Shared Electronic Gaming System

Figure 5:
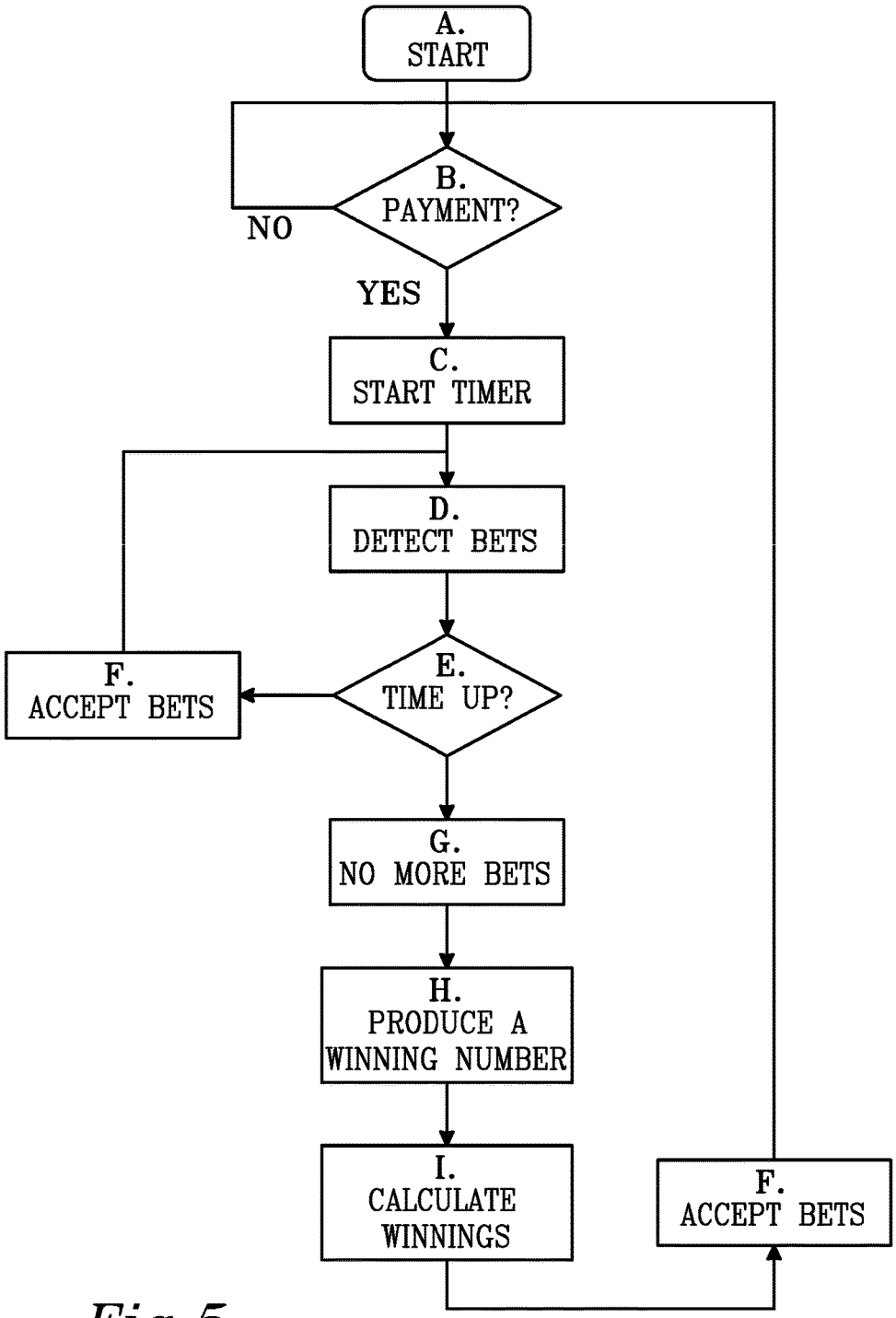
FIG. 5 shows a flow chart that illustrates the function of an exemplifying shared electronic gaming system.

A start up of the shared electronic gaming system 400 begins with block A in the flowchart shown in FIG. 5. The system 400 is initialized and internal checks are made to verify that the system 400 is ready to initiate a game of roulette. The electronic gaming system 400 and the shared electronic gaming table 10 may be one and the same, especially in embodiments that have the croupier control unit 430 and the roulette wheel unit 440 integrated into the electronic gaming table 10. It is preferred that the electronic gaming system 400 is initiated with a playing surface 100 that displays four separate betting areas 200*a*-200*d* as illustrated in FIG. 2*b* or similar.

When a game has been initiated in block A the operation of the shared electronic gaming system 400 proceeds to block B and waits until at least one player console 40*a*-40*d* receives an amount of money or similar in its payment arrangement 41*a*-41*d* as described above.

A payment in at least one payment arrangement 41*a*-41*d* initiates the betting phase in block C, wherein a game clock starts a predefined countdown period. The predefined countdown period is preferably selected via the croupier control unit 420.

Bets are then detected in block D.

The following block E passes the detected bets to block F for processing and displaying on the relevant betting area 200*a*-200*d*, provided that the betting period started in block C has not expired. When block E detects the expiration of the betting period it will pass the control to block G.

The touch screen 110 is commanded in block G to display the text "NO MORE BETS" and/or the loudspeakers 43*a*-43*d* are commanded to sound the message "NO MORE BETS". In the case of a game of roulette it is preferred that it is moreover preferred that the touch screen 110 is commanded to merge the four separate betting areas 200*a*-200*d* or similar into a shared area 200 as illustrated in FIG. 2*a*.

A winning number or similar is produced in the following block H. In the case of a game of roulette it is preferred that the winning number is produced by a croupier spinning a traditional roulette wheel and dropping the ball into the wheel, which events are reproduced by a camera or similar as discussed above. However, the croupier function may alternatively be computer-generated by the croupier control unit 430 or the table control unit 50 or similar. It is moreover preferred that the winning number or similar is displayed on the shared betting area 200.

When the winning number has been produced in block H the operation of the shared electronic gaming system 400 proceeds to block I, in which the winnings awarded to the players are calculated.

According to block J the calculated winnings are distributed to the players, which will increase the amount following the text "Credit:" associated with the betting area or areas 200*a*-200*d* on which a winning bet or bets was placed.

The present invention has now been described by means of preferred embodiments. However, the invention is not limited to the embodiments described above. On the contrary, the operation of the electronic gaming system illustrated by the flowchart in FIG. 5 may for example comprise further steps and/or steps that are performed according to another sequence than the one described in connection with FIG. 5. Moreover, the exemplifying electronic gaming table 10 illustrated in FIGS. 1*a*-1*c* may comprise more units or similar units in addition to the ones illustrated in FIGS. 1*a*-1*c*.

REFERENCE SIGNS

10 Shared Electronic Gaming table
10' Shared Electronic Gaming table
20 Table Top
30*a* Supporting Side/Floor Support
30*b* Supporting Side/Floor Support
31*a* Short Side
31*b* Short Side
40*a* Player Console
40*b* Player Console
40*c* Player Console
40*d* Player Console
41*a* Payment Arrangement
42*a* Payout Arrangement
43*a* Loudspeaker
50 Table Control Unit
100 Playing Surface
110 Touch Screen
200 Shared Roulette Betting area
200*a* Separate Roulette Betting Area
200*b* Separate Roulette Betting Area
200*c* Separate Roulette Betting Area
200*d* Separate Roulette Betting Area
300 Roulette Wheel
400 Shared Electronic Gaming system
410 Transmission Network
420 Table Control Unit
430 Croupier Control Unit
431 Main Control Image
440 Roulette Wheel Unit

What is claimed is:

1. An electronic gaming table for playing a table game, comprising:

at least one processor; and a table top provided with a single continuous playing surface arranged for dynamically and simultaneously displaying a current game status for a plurality of players participating in a game currently played on the electronic gaming table, wherein:

said single continuous playing surface is implemented by a touch screen arranged to receive and detect touches from said plurality of players, said at least one processor is configured to control said touch screen to switch between displaying a shared betting area for said plurality of players and a plurality of separate, individual betting areas during the playing of the game, each individual betting area corresponding to one of the plurality of players participating in the game, said touch screen is configured to distinguish between touches made simultaneously by different users on different areas of the touch screen, and the whole surface of the touch screen is arranged to receive and detect touches from the plurality of players.

2. The electronic gaming table as recited in claim 1, wherein said table game is one of: roulette, craps, sic bo, blackjack, twenty-one, red dog or baccarat.

3. The electronic gaming table as recited in claim 1, wherein said at least one processor is configured to control said touch screen to switch from displaying the shared betting area to the plurality of individual betting areas when betting in the game begins.

4. The electronic gaming table as recited in claim 3, wherein said at least one processor is configured to control said touch screen to switch from displaying the plurality of individual betting areas to the shared betting area when betting in the game ends.

5. A method for playing a table game on an electronic gaming table comprising a table top provided with a single continuous playing surface configured for dynamically and simultaneously displaying a current game status for a plurality of players participating in a game currently played on the electronic gaming table, said method comprising:

receiving and detecting touches on said single continuous playing surface from said plurality of players by a touch screen, wherein:

said touch screen switches between displaying a shared betting area for said plurality of players and a plurality of separate, individual betting areas during the playing of the game, each individual betting area corresponding to one of the plurality of players participating in the game, said touch screen is configured to distinguish between touches made simultaneously by different users on different areas of the shared betting area provided at the touch screen, and the whole surface of the touch screen is arranged to receive and detect touches from the plurality of players.

6. The method as recited in claim 5, wherein said individual betting area is at least partly a betting area or a card hand that is associated with said player.

7. The method as recited in claim 6, wherein said table game is one of: roulette, craps, sic bo, blackjack, twenty-one, red dog or baccarat.

8. The method as recited in claim 5, wherein said table game is one of: roulette, craps, sic bo, blackjack, twenty-one, red dog or baccarat.

9. The method as recited in claim 5, wherein said touch screen switches from displaying the shared betting area to the plurality of individual betting areas when betting in the game begins.

10. The method as recited in claim 9, wherein said touch screen switches from displaying the plurality of individual betting areas to the shared betting area when betting in the game ends.

* * * * *